US006217356B1

(12) United States Patent
Davis et al.

(10) Patent No.: US 6,217,356 B1
(45) Date of Patent: Apr. 17, 2001

(54) ELECTRICAL TERMINAL WITH ARC ARRESTING REGION

(75) Inventors: Wayne Samuel Davis, Harrisburg; Robert Neil Whiteman, Jr., Middletown, both of PA (US)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/281,390

(22) Filed: Mar. 30, 1999

(51) Int. Cl.[7] ..... H01R 13/62; H01R 11/22; H01R 13/11

(52) U.S. Cl. ..... 439/181; 431/856

(58) Field of Search ..... 439/181, 851, 439/857, 180, 218, 856, 637, 82, 59, 520

(56) References Cited

U.S. PATENT DOCUMENTS

| | | | | |
|---|---|---|---|---|
| 4,241,970 | | 12/1980 | Rider, Jr. et al. | 339/99 R |
| 4,514,030 | * | 4/1985 | Triner et al. | 439/188 |
| 4,607,907 | | 8/1986 | Bogursky | 339/258 P |
| 4,647,130 | | 3/1987 | Blair et al. | 339/248 |
| 4,734,041 | | 3/1988 | Bruchmann et al. | 439/637 |
| 4,752,246 | | 6/1988 | Triner et al. | 439/682 |
| 4,973,273 | | 11/1990 | DePriest | 439/856 |
| 5,004,426 | | 4/1991 | Barnett | 439/82 |
| 5,009,606 | | 4/1991 | Villeneuve et al. | 439/59 |
| 5,135,417 | | 8/1992 | Stanevich | 439/851 |
| 5,176,528 | | 1/1993 | Fry et al. | 439/181 |
| 5,252,097 | | 10/1993 | Lindeberg et al. | 439/856 |
| 5,319,523 | | 6/1994 | Ganthier et al. | 361/753 |
| 5,417,596 | | 5/1995 | Kusakabe | 439/857 |
| 5,458,513 | | 10/1995 | Matsuoka | 439/857 |
| 5,551,897 | | 9/1996 | Alwine | 439/850 |
| 5,591,039 | | 1/1997 | Matthews | 439/181 |
| 5,672,084 | | 9/1997 | Feldman | 439/852 |
| 5,683,267 | | 11/1997 | Ribbeck et al. | 439/395 |
| 5,741,161 | * | 4/1998 | Cahaly et al. | 439/709 |

OTHER PUBLICATIONS

Drawings and Abstract for pending application 16578, Ser. No. 09/092,473, Filed Jun. 5, 1998.

Drawings and Abstract for pending application 16579, Ser. No. 08/899,458, Filed Jul. 23, 1997.

Drawings and Abstract for pending application 16581, Ser. No. 08/899,421, Filed Jul. 23, 1997.

* cited by examiner

*Primary Examiner*—Brian Sircus
*Assistant Examiner*—Chandrika Prasad

(57) ABSTRACT

An electrical terminal (20) including a body (22) having first and second connecting portions (30, 50). The first connecting portion (30) includes two beams defining a terminal-receiving slot (44) therebetween. Each beam (32) has a primary contact surface (38) and at least one beam includes a secondary contact surface (40) extending orthogonally into the terminal-receiving slot (44). The primary and secondary contact surfaces on the one beam are spaced both vertically and horizontally from each other. Upon mating a pin terminal (70) to electrical terminal (20) the secondary contact surface (40) engages the pin terminal (70) at a first location (74) thereon defining an electrical arc- arresting region. Upon further insertion the pin terminal (70) engages the primary contact surfaces (38) at second locations (76) thereon spaced at least horizontally from the first locations (74).

18 Claims, 5 Drawing Sheets

ELECTRICAL TERMINAL WITH ARC ARRESTING REGION

FIELD OF THE INVENTION

This invention relates to electrical connectors and more particularly to electrical terminals having a region to accommodate deterioration owing to electrical arcing.

BACKGROUND OF THE INVENTION

Electrical connectors are sometimes used in applications wherein the connectors need to be mated and unmated without first disconnecting the power source. When an electrical potential exists between the terminals of the connectors, arcing can occur as they are mated and unmated, thus causing deterioration of the terminals. Various approaches have been used to reduce such deterioration or to fabricate terminals that can withstand deterioration.

U.S. Pat. No. 5,176,528 discloses a pin and socket connector assembly in which each of a pair of power lines is connected to a pair of mating terminals such that one of each pair of mating terminals are allowed to deteriorate or be "sacrificed" while the integrity of the other of the pair is maintained. The use of a pair of "sacrificial" terminals for each power line increases the number of terminals that must be included in a connector housing and the overall dimensions of the connector.

U.S. Pat. No. 5,591,039 discloses the use of an arc arresting or sacrificial ring located near the opening of each socket terminal in the connector. The mating pin terminal engages the ring, which receives any electrical arc before the pin terminal engages the socket terminal. This approach requires an extra member for each receptacle terminal and additional steps to assemble the connector.

It is desirable and more cost effective, however, to have an electrical terminal that can provide a sacrificial function as well as maintain the integrity of the electrical connection.

SUMMARY OF THE INVENTION

The present invention is directed to a socket terminal that overcomes the problems of the prior art. The electrical terminal includes a body having first and second connecting portions. The first connecting portion is adapted to mate with a pin terminal and includes two beams extending substantially parallel to one another from an edge of the body and defining a terminal-receiving slot therebetween. Each beam has a primary contact surface spaced inwardly form leading ends of the beams and extending orthogonally into the terminal-receiving slot. At least one of the beams includes a secondary or sacrificial contact surface proximate the leading end thereof. The primary and secondary contact surfaces on the at least one beam are spaced both vertically and horizontally from each other. The corresponding primary contact surfaces of the two beams are substantially opposed to each other. Upon inserting a pin terminal into the terminal-receiving slot, the secondary or sacrificial contact surface engages the pin terminal at at least one first location thereon. Upon further insertion of the pin, the pin engages the primary contact surfaces at second locations thereon, the second locations being spaced at least horizontally from the at least one first location on the pin. The secondary or sacrificial contact surface on the at least one beam and the at least one first locations on the pin terminal define an electrical arc arresting region thereby preventing deleterious electrical arcing between the pin terminal at the second locations and the primary contact surfaces on the beams.

For purposes of illustrating the invention, the terminal is being shown in a terminal block for use in a control panel.

It is an object of the invention to provide an electrical terminal that includes a structure that provides at least one electrical arc-arresting region and a separate region for electrical connection when the connectors having the terminals are fully mated.

It is another object of the invention to provide an electrical terminal having the above capabilities that is cost effective to manufacture.

It is a further object of the invention to provide electrical terminals for terminating to stripped wire ends that prevent the wires from entering the socket that is to be mated to a pin terminal.

Embodiments of the invention will now be described by way of example with reference to the accompanying drawings.

DETAILED DESCRIPTION OF THE DRAWINGS

Figure 1:
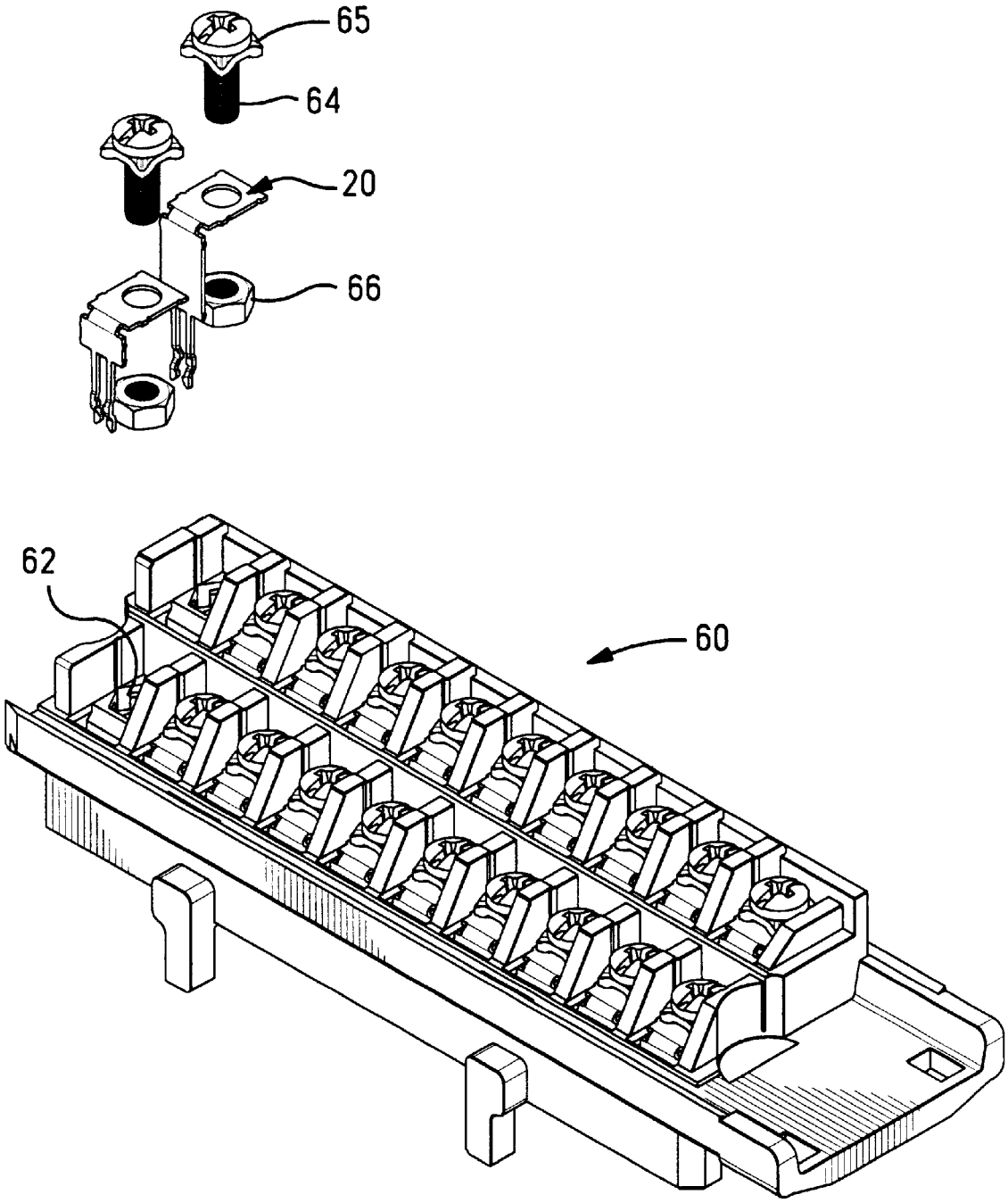
FIG. 1 is an isometric view of a terminal block with a terminal made in accordance with the invention exploded therefrom.

Referring first to FIGS. 1 through 8, electrical terminal 20 includes a body 22 having first and second connecting portions 30, 50. The first connecting portion 30 includes two beams 32 that extend from body edge 24 to leading ends 34, each beam further including a C-shaped bend 36 intermediate the leading end 34 and terminal body 22. Beams 32 are essentially parallel to each other and define a terminal-receiving slot 44 therebetween. Each beam 32 includes a primary contact surface 38 on the C-shaped bend. At least one of the beams 32 includes a secondary or sacrificial contact surface 40 proximate the leading end 34 thereof. In the embodiment shown, both of the beams 32 include secondary contact surfaces 40. It is to be understood that only one of the beams needs the sacrificial contact surface. The primary and secondary contact surfaces 38, 40 of each beam extend orthogonally into slot 44 and are spaced both vertically and horizontally from one another. The primary and secondary contact surfaces 38, 40 of one of the two beams 32 are opposed to the corresponding primary and secondary contact surfaces of the other of the two beams 32.

Terminal 20 is stamped from an iron copper alloy or other suitable metal stock having a thickness of about 0.5 millimeters and is selectively plated at the contact surfaces with a noble metal such as a gold alloy, as known in the art. The beams of terminal 20 generate a sufficient normal force to interconnect to signal carrying terminals and the terminal has sufficient thickness and current carrying capability to transmit power.

Figure 2:
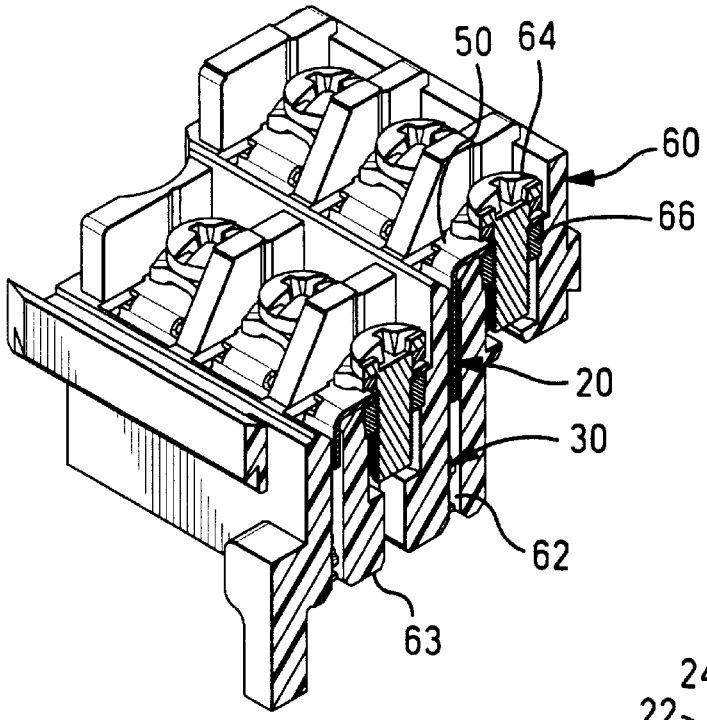
FIG. 2 is a cross-sectional view of the terminal block of FIG. 1.
Figure 3:
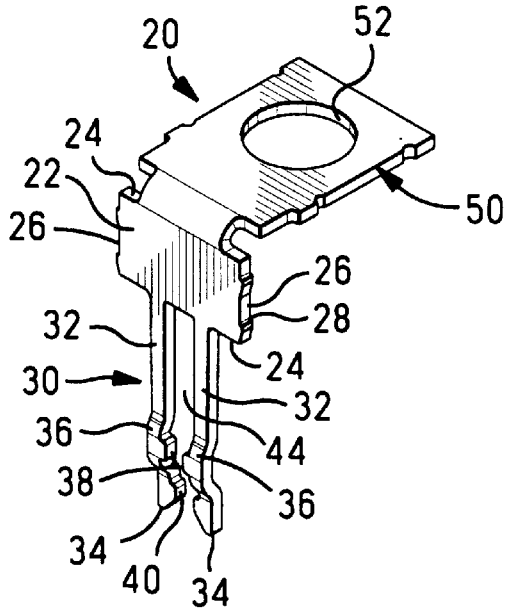
FIG. 3 is an isometric view of a terminal made in accordance with the invention.
Figure 4:
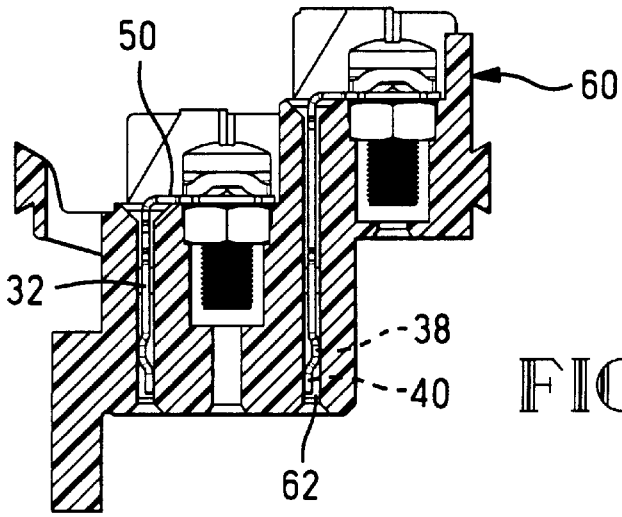
FIG. 4 is a plan view of a cross-section of the terminal block of FIG. 1 illustrating the position of terminals in the terminal-receiving passageways.

FIGS. 1, 2, and 4 illustrate the position of terminals 20 in terminal-receiving passageways 62 of a terminal block housing 60. Body 22 of terminal 20 includes barbs 28 extending from side edges 26 for securing the terminal 20 in the passageway 62. For purposes of illustration, terminal block housing 60 is of the type disclosed in U.S. patent application Ser. No. 08/899,458. It is to be understood that terminal 20 may be used in other connector housings and terminal block configurations. As can be seen in these Figures. the primary contact surfaces 38 are adjacent one side of passageway 62, the secondary contact surfaces 40 are adjacent the opposite side of passageway 62, and slot 44 is open to the mating face 63 of the housing.

The second connecting portion 50 of terminal 20 is shown as a flat member extending orthogonally from body 22. Portion 50 includes aperture 52 and is adapted to be received on an upper surface of the housing 60 and secured thereto with screw 64 and nut 66, or other devices as known in the art. The collar 65 of screw 64 is adapted to engage a stripped end of a wire (not shown), as known in the art.

Figure 5:
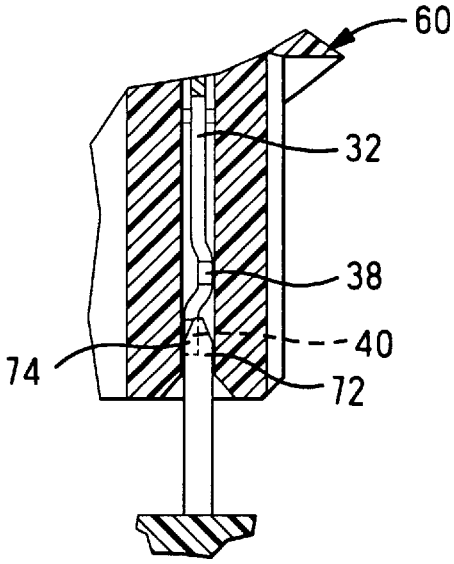
FIGS. 5 and 6 are sectional views of the terminal block illustrating a pin terminal engaging the leading end of a terminal made in accordance with the invention.
Figure 6:
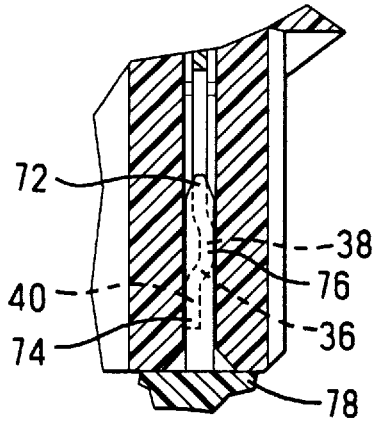
Figure 7:
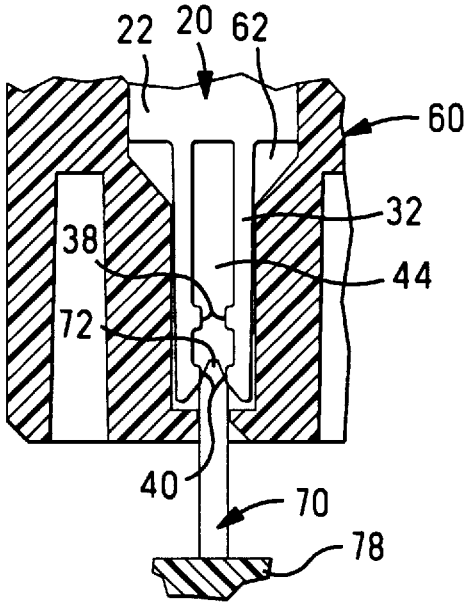
FIGS. 7 and 8 are sectional views similar to those of FIGS. 5 and 6 illustrating the position of the two terminals after the terminals have been fully mated.
Figure 8:
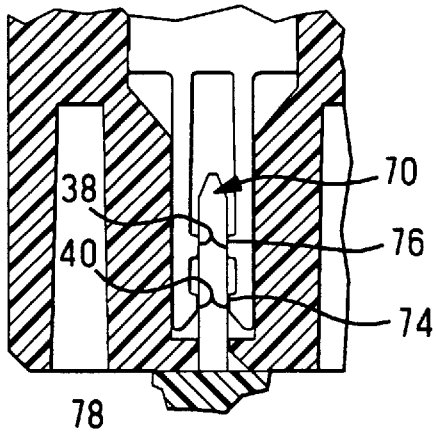
Figure 9:
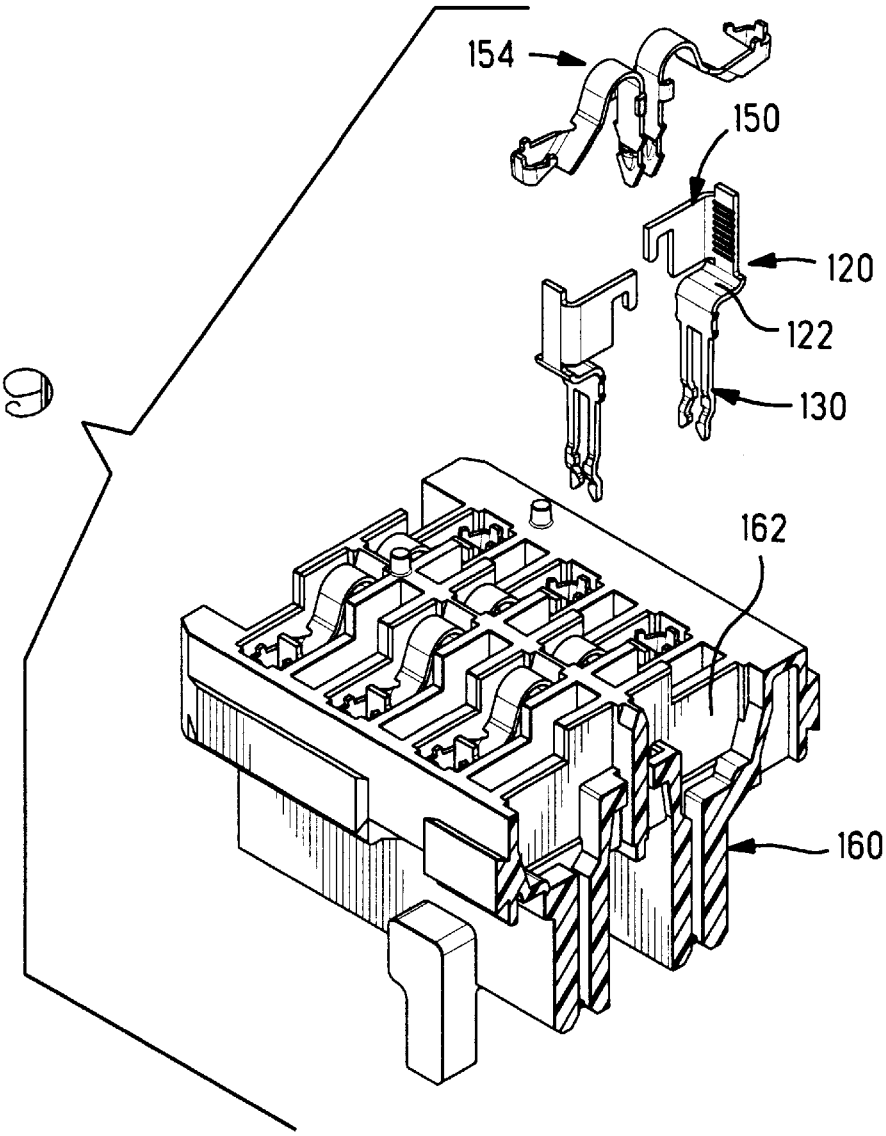
FIG. 9 is a fragmentary portion of a terminal block having an alternative embodiment of the electrical terminal exploded therefrom.
Figure 10:
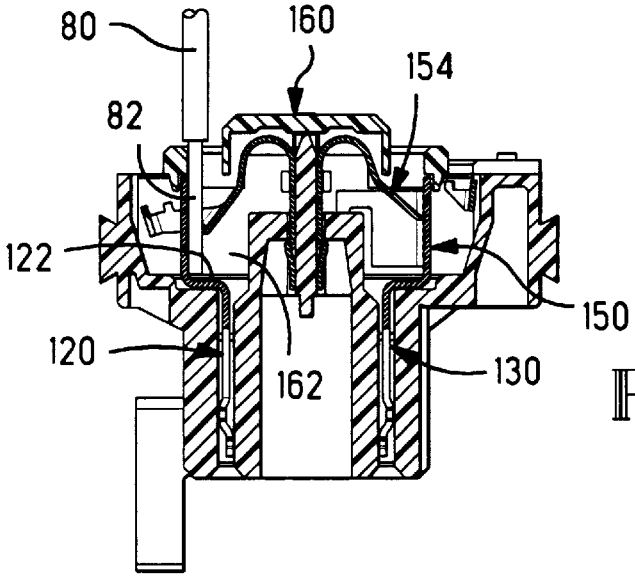
FIG. 10 is a cross-sectional plan view of the terminal block assembly of FIG. 9.
Figure 11:
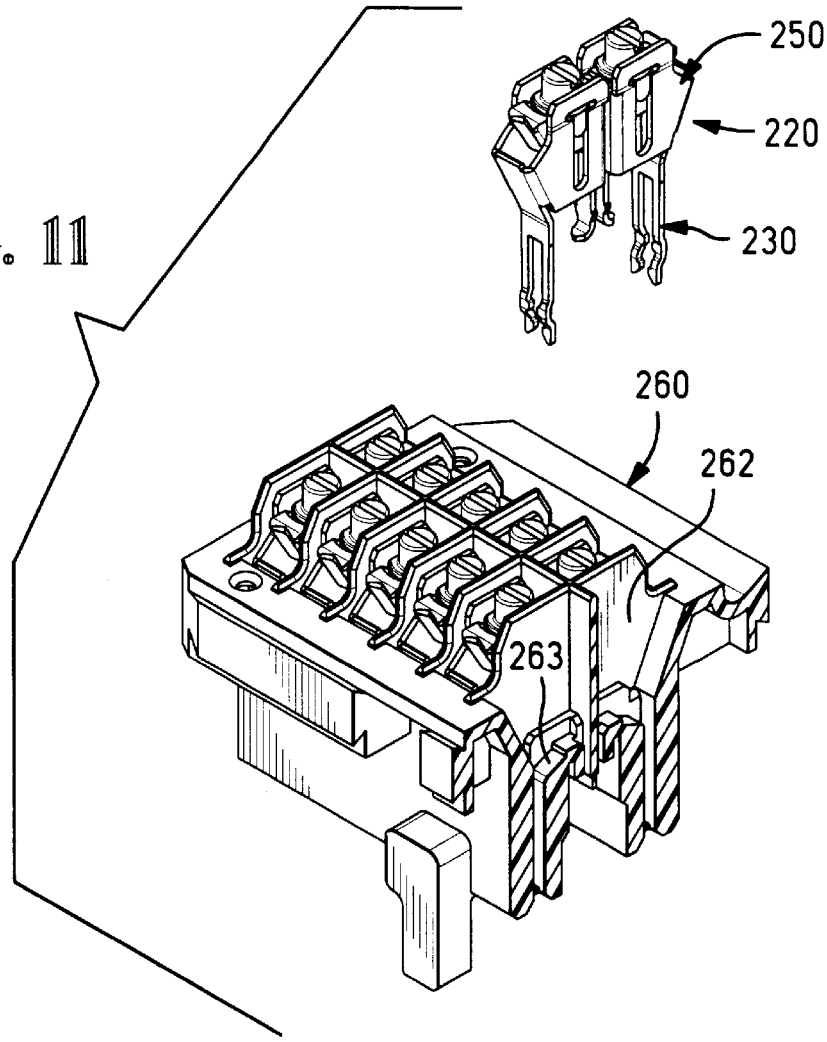
FIG. 11 is a fragmentary portion of a terminal block having a further embodiment of the terminal exploded therefrom.
Figure 12:
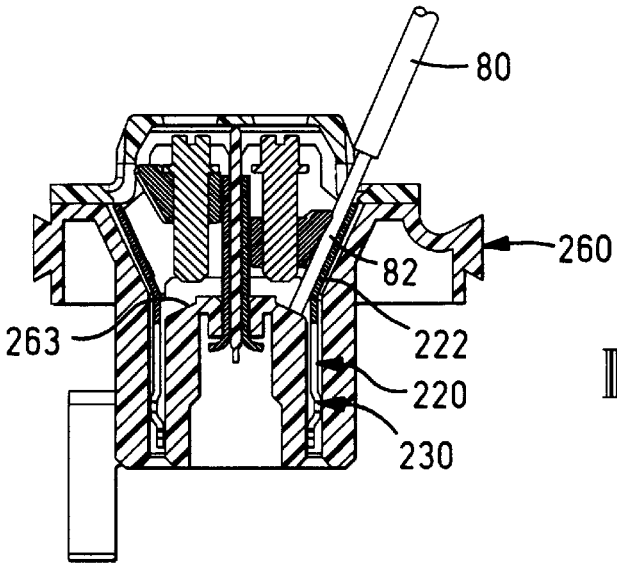
FIG. 12 is a cross-sectional plan view of the terminal block assembly of FIG. 11.

FIGS. 5 through 8 illustrate the mating sequence of a pin terminal 70 in housing 78 with the socket terminal 32 in housing passageway 62. For purposes of illustration the portions of beams 32 underlying pin terminal 70 are shown in phantom. As the leading end 72 of pin terminal 70 enters passageway 62, it is received in terminal-receiving slot 44 and is moved into physical and electrical engagement with secondary or sacrificial contact surfaces 40 of terminal 30 at first locations 74 on two sides of pin terminal 70, as shown in FIGS. 5 and 6. Upon further insertion of the pin terminal 70 into slot 44, the pin terminal 70 engages primary contact surfaces 38 at second pin locations 76, as shown in FIGS. 7 and 8. As can best be seen in FIGS. 5 and 7, the first and second pin locations 74, 76 are along opposite edges of pin terminal 70 and are at least spaced horizontally from one another. The secondary or sacrificial contact surfaces 40 and first pin terminal locations 74 define electrical arc-arresting regions that receive any arcing that may occur as the respective terminals 20, 70 are mated or unmated while power is applied to the connector assembly. The electrical arc-arresting regions prevent deleterious electrical arcing between the pin terminal at second locations 76 and primary contact surfaces 38. The two beams 32 of the socket terminal 20 provide multiple points of contact at each of the locations 74, 76, which is desirable for carrying power. FIGS. 9 and 10 illustrate another embodiment 120 of a terminal made in accordance with the invention. In this embodiment, the first connecting portion 130 is identical to that of terminal 20. The second connecting portion 150 is adapted to cooperate with a spring clamp 154 of the type disclosed in U.S. patent application Ser. No. 09/092,473. FIG. 10 illustrates one wire 80 mated with a terminal 120. The body 122 of second connecting portion 150 is configured to be received in a terminal-receiving passageway 162 of terminal block housing 160 such that body 122 provides a stop surface for the stripped end 82 of wire 80, thereby preventing the bare wire from being inserted too far into the passageway and into the first connecting section. FIGS. 11 and 12 illustrate a further embodiment 220 of a terminal made in accordance with the invention. In this embodiment the first connecting portion 230 is identical to that of terminal 20. The second connecting portion 250 is a cage design, as known in the art. FIG. 12 illustrates one wire 80 mated with a terminal 220. As best seen in FIG. 12, the body 222 of second connecting portion 250 and terminal-receiving passageway 262 of terminal block housing 260 are configured such that passageway surface 263 provides a stop surface for the stripped end 82 of wire 80, thereby preventing the bare wire from being inserted too far into the passageway and into the first connecting section.

The present invention has the advantage of providing two separate electrical connecting areas for each mating pair of terminals. The initial connection at a first location defines an arc-arresting region that protects the integrity of the electrical connection between the pair at a second location. The terminal has the capability to transmit power as well as signals.

It is thought that the electrical terminal of the present invention and many of its attendant advantages will be understood from the foregoing description. It is apparent that various changes may be made in the form, construction, and arrangement of the parts thereof without departing from the spirit or scope of the invention, or sacrificing all of its material advantages.

We claim:

1. An electrical terminal comprising:

a body having first and second connecting portions;

said first connecting portion being adapted to mate with a pin terminal and including two beams extending substantially parallel to one another from an edge of said body and defining a terminal-receiving slot therebetween;

each beam having a primary contact surface inwardly of a leading end thereof and at least one of said beams includes a secondary contact surface proximate said leading end, said contact surfaces extending substantially orthogonally into said terminal-receiving slot, said primary and secondary contact surfaces on said at least one beam being spaced both vertically and horizontally from each other, said corresponding primary contact surfaces of the two beams being substantially opposed to each other;

whereby, upon inserting a pin terminal into said terminal-receiving slot, said at least one secondary contact surface engages said pin terminal at at least one first location thereon and upon further insertion said pin terminal engages said primary contact surfaces at second locations thereon, said second locations being spaced at least horizontally from said at least one first location on said pin terminal, said secondary contact surface and first location defining an electrical arc arresting region thereby preventing deleterious electrical arcing between said pin terminal at said second locations and said primary contact surfaces on said beams.

2. The electrical terminal of claim 1 wherein each beam includes a C-shaped bend intermediate said leading end and said body and wherein said primary contact surface is located on said bend.

3. The electrical terminal of claim 1 wherein said second connecting portion is adapted to be terminated to an end of a wire.

4. The electrical terminal of claim 3 wherein said body of said terminal is configured to provide a wire stop for said wire end to prevent said wire end from being inserted beyond said body and into said first connecting portion.

5. The electrical terminal of claim 1 wherein both of said beams have secondary contact surfaces at leading ends thereof.

6. The electrical terminal of claim 5 wherein each beam includes a C-shaped bend intermediate said leading end and said body and wherein said primary contact surface is located on said bend.

7. The electrical terminal of claim 5 wherein said second connecting portion is adapted to be terminated to an end of a wire.

8. The electrical terminal of claim 7 wherein said body of said terminal is configured to provide a wire stop for said wire end to prevent said wire end from being inserted beyond said body and into said first connecting portion.

9. An electrical connector comprising:

a dielectric housing having a plurality of terminal-receiving passageways therein extending to a mating face of said housing; and a plurality of electrical terminals, each disposed in a respective passageway thereof, each terminal including:

a body having first and second connecting portions;

said first connecting portion being adapted to mate with a pin terminal and including two beams extending substantially parallel to one another from one of said body edges and defining a terminal-receiving slob therebetween, said slot being exposed at said mating face;

each beam having a primary contact surface inwardly of a leading end thereof and at least one of said beams includes a secondary contact surface proximate said leading end, said contact surfaces extending substantially orthogonally into said terminal-receiving slot, said primary and secondary contact surfaces on said at least one beam being spaced both vertically and horizontally from each other, said corresponding primary contact surfaces of the two beams being substantially opposed to each other;

whereby, upon inserting a pin terminal into said terminal-receiving slot, said at least one secondary contact surface engages said pin terminal at at least one first location thereon and upon further insertion said pin terminal engages said primary contact surfaces at second locations thereon, said second locations being spaced at least horizontally from said at least one first location on said pin terminal, said secondary contact surface and first location defining an electrical arc arresting region thereby preventing deleterious electrical arcing between said pin terminal at said second locations and said primary contact surfaces on said beams.

10. The electrical connector of claim 9 wherein each beam includes a C-shaped bend intermediate said leading end and said body and wherein said secondary contact surface is adjacent one side wall of said passageway and said primary contact surface is located on said bend and adjacent an opposed side wall of said passageway.

11. The electrical connector of claim 9 wherein said second connecting portion of each said electrical terminal is adapted to be terminated to an end of a wire.

12. The electrical connector of claim 11 wherein said body of each said terminal is configured to provide a wire stop for said wire end to prevent said wire end from being inserted beyond said body and into said first connecting portion.

13. The electrical connector of claim 11 wherein said terminal-receiving passageway is configured to provide a wire stop for said wire end to prevent said wire end from being inserted beyond said terminal body and into said first connecting portion.

14. The electrical connector of claim 9 wherein both of said beams of each said electrical terminal have secondary contact surfaces at leading ends thereof.

15. The electrical connector of claim 14 wherein each beam of each said electrical terminal includes a C-shaped bend intermediate said leading end and said body and wherein said primary contact surface is located on said bend.

16. The electrical connector of claim 14 wherein said second connecting portion of each said electrical terminal is adapted to be terminated to an end of a wire.

17. The electrical connector of claim 16 wherein said body of each said electrical terminal is configured to provide a wire stop for said wire end to prevent said wire end from being inserted beyond said body and into said first connecting portion.

18. The electrical connector of claim 16 wherein said terminal-receiving passageway is configured to provide a wire stop for said wire end to prevent said wire end from being inserted beyond said terminal body and into said first connecting portion.

* * * * *